US008118976B2

(12) United States Patent
Johansson-Vestin et al.

(10) Patent No.: US 8,118,976 B2
(45) Date of Patent: Feb. 21, 2012

(54) PROCESS FOR THE PRODUCTION OF A CELLULOSIC PRODUCT

(75) Inventors: Hans Johansson-Vestin, Kungälv (SE); Arne Andersson, Stenungsund (SE); Fredrik Solhage, Boras (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 12/600,139

(22) PCT Filed: Apr. 28, 2008

(86) PCT No.: PCT/SE2008/050481

§ 371 (c)(1), (2), (4) Date: Nov. 13, 2009

(87) PCT Pub. No.: WO2008/143580

PCT Pub. Date: Nov. 27, 2008

(65) Prior Publication Data

US 2010/0236737 A1 Sep. 23, 2010

Related U.S. Application Data

(60) Provisional application No. 60/931,500, filed on May 23, 2007.

(30) Foreign Application Priority Data

May 23, 2007 (EP) ..... 07108718

(51) Int. Cl.
*D21H 11/00* (2006.01)

(52) U.S. Cl. ..... 162/181.6; 162/158

(58) Field of Classification Search ..... 162/181.6, 162/158, 168.3, 164.1, 175, 178
See application file for complete search history.

(56) References Cited

U.S. PATENT DOCUMENTS

| | | | |
|---|---|---|---|
| 2,399,981 | A | 5/1946 | Britt |
| 2,727,008 | A | 12/1955 | Iler |
| 2,801,938 | A | 8/1957 | Iler |
| 2,926,154 | A | 2/1960 | Keim |
| 2,980,558 | A | 4/1961 | Dempey et al. |
| 3,311,594 | A | 3/1967 | Earle, Jr. |
| 3,556,933 | A | 1/1971 | Williams et al. |
| 3,700,623 | A | 10/1972 | Keim |
| 3,772,076 | A | 11/1973 | Keim |
| 3,891,589 | A | 6/1975 | Ray-Chaudhuri |
| 4,033,913 | A | 7/1977 | Sunden |
| 4,336,835 | A | 6/1982 | Takagishi et al. |
| 4,388,150 | A | 6/1983 | Sunden et al. |
| 4,416,729 | A | 11/1983 | Killat et al. |
| 4,442,172 | A | 4/1984 | Oshima et al. |
| 4,468,428 | A | 8/1984 | Early et al. |
| 4,605,702 | A | 8/1986 | Guerro et al. |
| 4,927,498 | A | 5/1990 | Rushmere |
| 4,954,220 | A | 9/1990 | Rushmere |
| 4,961,825 | A | 10/1990 | Andersson et al. |
| 4,980,025 | A | 12/1990 | Andersson et al. |
| 5,127,994 | A | 7/1992 | Johansson |
| 5,176,891 | A | 1/1993 | Rushmere |
| 5,200,036 | A | 4/1993 | Noda |
| 5,368,833 | A | 11/1994 | Johansson et al. |
| 5,385,643 | A | 1/1995 | Ampulski |
| 5,447,604 | A | 9/1995 | Johansson et al. |
| 5,470,435 | A | 11/1995 | Rushmere et al. |
| 5,543,014 | A | 8/1996 | Rushmere et al. |
| 5,571,494 | A | 11/1996 | Saastamoinen |
| 5,573,674 | A | 11/1996 | Lind et al. |
| 5,584,966 | A | 12/1996 | Moffett |
| 5,603,805 | A | 2/1997 | Andersson et al. |
| 5,627,224 | A | 5/1997 | Lyrmalm et al. |
| 5,643,414 | A | 7/1997 | Johansson et al. |
| 5,679,219 | A | 10/1997 | Harms et al. |
| 5,688,482 | A | 11/1997 | Saastamoinen |
| 5,688,805 | A | 11/1997 | Ting et al. |
| 5,707,493 | A | 1/1998 | Saastamoinen |
| 5,858,174 | A | 1/1999 | Persson et al. |
| 6,551,457 | B2 | 4/2003 | Westman et al. |
| 2003/0136534 | A1 | 7/2003 | Johansson-Vestin et al. |
| 2005/0155731 | A1 | 7/2005 | Martin et al. |
| 2006/0057365 | A1 | 3/2006 | Swoboda et al. |

FOREIGN PATENT DOCUMENTS

| | | | |
|---|---|---|---|
| EP | 0 351 397 | B1 | 1/1990 |
| EP | 0 776 923 | A2 | 6/1997 |
| EP | 1 047 834 | B1 | 11/2000 |
| EP | 1 770 214 | A1 | 4/2007 |
| WO | WO 00/17450 | A1 | 3/2000 |
| WO | WO 00/29670 | A1 | 5/2000 |
| WO | WO 2006/068964 | A2 | 6/2006 |

OTHER PUBLICATIONS

Abstract of EP 0 351 397 from Questel QPAT.

(Continued)

*Primary Examiner* — Mark Halpern
(74) *Attorney, Agent, or Firm* — Robert C. Morriss

(57) ABSTRACT

The present invention concerns a process for the production of a cellulosic product comprising providing a fiber-containing suspension, wherein at least about 60% by weight of the fibers are cellulosic fibers, and dewatering the suspension on a wire to form a cellulosic fiber web, the process further comprising adding silica-based particles to the formed web and a wet strength agent to the suspension and/or to the formed web. The invention also concerns a product obtainable by the process. The invention further concerns a dispersion comprising silica-based particles and a substantially aldehyde-free wet strength agent. A further aspect of the invention concerns a dispersion comprising silica-based particles having a specific surface area ranging from about 1000 to about 1700 $m^2/g$ and a wet strength agent. Still another aspect of the invention concerns the use of the dispersion as an additive in a papermaking process.

15 Claims, No Drawings

OTHER PUBLICATIONS

Sears, Jr. G. W., "Determination of Specific Surface Area of Colloidal Silica by Titration with Sodium Hydroxide," Analytical Chemistry 28 (1956); 12, pp. 1981-1983.

Iler et al., "Degree of Hydration of Particles of Colloidal Silica in Aqueous Solution," J. Phys. Chem. 60 (1956), pp. 955-957.

Scott, William, "Principles of Wet End Chemistry," TAPPI Press, 1996, pp. 62-65.

International Search Report with Written Opinion for International Application No. PCT/SE2008/050481 dated Aug. 5, 2008.

International Preliminary Report on Patentability for International Application No. PCT/SE2008/05481 dated Aug. 26, 2009.

PROCESS FOR THE PRODUCTION OF A CELLULOSIC PRODUCT

This application is a national stage filing under 35 U.S.C. §371 of PCT/SE2008/050481, filed Apr. 28, 2008, which claims priority to European Patent Application No. 07108718.3, filed May 23, 2007, and U.S. Provisional Patent Application No. 60/931,500, filed on May 23, 2007, the contents of which are incorporated herein by reference in their entirety.

The present invention relates to a process for the production of a cellulosic product improving at least one of the parameters wet strength, wet stiffness, relative wet strength and relative wet stiffness. The present invention particularly relates to a process for the production of a cellulosic product comprising adding silica-based particles to a formed web and a wet strength agent to a fiber-containing suspension and/or formed web, and to a cellulosic product obtainable by the process. The invention further relates to a dispersion comprising silica-based particles and a wet strength agent and the use of the dispersion as an additive in a papermaking process.

BACKGROUND

Cellulosic products and methods for making such products are well known in the art. Cellulosic products are typically made by draining a fiber-containing suspension and forming a web on a wire. The suspension is usually contained in a headbox before being deposited as a thin layer on the wire. The fiber web is typically dewatered by vacuum dewatering and pressing operations wherein the web is subjected to pressure developed by opposing mechanical members, for example cylindrical rolls or an extended nip press.

Cellulosic products generally have a low wet strength and wet stiffness and often exhibit dimensional changes in humid conditions which can limit their performance and usefulness. Therefore, dimensional stability is an important factor, for instance in packaging materials. However, it has been difficult to increase the wet strength without simultaneously increasing the dry strength to the same extent. When the dry strength increases too much, cellulosic products, such as cardboard and tissue paper, may become too brittle or too hard when dry which is undesirable in many applications. It is desirable that tissue paper is strong when wet but soft when in a dry state. Cardboard should have good dimension stability when wet or damp but it should not be too brittle when dry. Therefore, it would be desirable to increase the wet strength and/or the wet stiffness without substantially influencing the dry strength and dry stiffness so as to increase the so called relative wet strength (RWStr) and relative wet stiffness (RWSti).

In the prior art, there have been several attempts to improve the wet strength and wet stiffness of cellulosic products.

U.S. Pat. No. 2,980,558 discloses a process in which a paper corrugating medium is impregnated with an essentially salt-free sol of active, non-aggregated silica at a pH below 6.0 to improve the stiffness of the corrugating medium at high relative humidity.

U.S. Pat. No. 4,033,913 discloses a process in which cellulose fibers are impregnated with a solution of monomer-oligomeric silicic acid to increase dry strength, wet strength, stiffness and chemical resistance of papers for technical use, such as filters for corrosive and oxidative liquids.

However, there is still a need to improve the wet strength and/or the wet stiffness properties of cellulosic products. It is an object of the present invention to provide a process which improves at least one of the parameters wet strength, wet stiffness, relative wet strength and/or relative wet stiffness of cellulosic products.

Another object of the present invention is to provide a dispersion imparting improved wet strength, wet stiffness, relative wet strength and/or relative wet stiffness to cellulosic products. Particularly, it is an object to provide a dispersion comprising environmentally adapted products, such as substantially aldehyde-free wet strength agents.

THE INVENTION

One aspect of the invention concerns a process for the production of a cellulosic product comprising:

(I) providing a fiber-containing suspension, wherein at least about 60% by weight of the fibers are cellulosic fibers;

(II) dewatering the suspension on a wire to form a cellulosic fiber web;

wherein the process further comprises adding:

(i) silica-based particles to the formed web; and (ii) a wet strength agent to the suspension and/or to the formed web.

Another aspect of the invention concerns a product obtainable by the process.

One further aspect of the invention concerns a dispersion comprising:

(a) silica-based particles; and (b) a substantially aldehyde-free wet strength agent.

A further aspect of the invention concerns a dispersion comprising:

(a) silica-based particles having a specific surface area ranging from about 1000 to about 1700 $m^2/g$; and (b) a wet strength agent.

Still another aspect of the invention concerns the use of the dispersion as an additive in a papermaking process.

Silica-based particles that can be used in the process or dispersion of the present invention include for example polysilicic acids, polysilicic acid microgels, polysilicates, polysilicate microgels, colloidal silica, colloidal aluminium-modified silica, polyaluminosilicates, polyaluminosilicate microgels, borosilicates, etc. Examples of suitable silica-based particles include those disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,573,674; 5,584,966; 5,603,805; 5,688,482; and 5,707,493, which are incorporated herein by reference. Examples of suitable silica-based particles include those having an average particle size below about 100 nm, e.g. below about 20 nm, for example in the range from about 1 to about 10 nm.

According to one embodiment, the silica-based particles are in the form of aqueous colloidal dispersions, so-called silica-based sols. The silica-based sols can be modified and contain other elements, e.g. aluminium, boron, nitrogen, zirconium, gallium and titanium, which can be present in the aqueous phase and/or inside and/or on the surface of the silica-based particles.

The specific surface area of the silica-based particles can be for example at least about 50, or at least about 100, and up to about 1700 $m^2/g$. The specific surface area is measured by means of titration with NaOH as described by G. W. Sears in Analytical Chemistry 28 (1956): 12, 1981-1983 and in U.S. Pat. No. 5,176,891 after appropriate removal of or adjustment for any compounds present in the sample that may disturb the titration such as aluminium and boron species. The given area thus represents the average specific surface area of the particles.

According to one embodiment, the silica-based particles can be present in a sol having an S-value ranging from about 8 to about 50%, for example from about 10 to about 40%. The S-value is measured and calculated as described by Iler & Dalton in J. Phys. Chem. 60 (1956), 955-957. The S-value indicates the degree of aggregation or microgel formation and a lower S-value is indicative of a higher degree of aggregation. According to one embodiment, the silica-based particles have a specific surface area ranging from about 300 to about 1000, e.g. from about 500 to about 950, or from about 750 to about 950 $m^2/g$. The dry content of the silica-based particles in the sol can range from about 1 to about 50, for example from about 5 to about 30 or from about 7 to about 30% by weight.

According to one embodiment, the silica-based particles have a specific surface area ranging from about 1000 to about 1700, e.g. from about 1050 to about 1600 $m^2/g$. The dry content of the silica-based particles in the dispersion according to the invention can be up to about 10, for example up to about 6, or up to about 4% by weight.

The term "wet strength", as used herein, refers to the mechanical strength of a cellulosic product and its ability to maintain physical integrity and resist tearing, bursting, and shredding when in use, especially in wet conditions. The term "wet stiffness", as used herein, refers to bending resistance of the cellulosic product in wet conditions. The relative wet strength value is defined as the ratio between the wet tensile index and the dry tensile index according to the formula RWStr (in %)=(WStr/DStr)*100, where RWStr stands for the relative wet strength, WStr is the wet tensile index and DStr is the dry tensile index of a paper. The relative wet stiffness, RWStif (in %)=(WStif/DStif)*100, is calculated by analogy with the relative wet strength.

Wet strength agents that can be used in the present process and dispersion include urea-formaldehyde resins (UF), melamine-formaldehyde resins (MF), dialdehyde-based resins, such as glyoxalated-polyacrylamide, and resins based on epihalohydrin, such as polyaminoamide-epichlorohydrin resin, and mixtures thereof.

According to one embodiment of the invention, the wet strength agent is selected from substantially aldehyde-free agents, such as epihalohydrin-based resins, e.g. polyaminoamide-epichlorohydrin resin (PAAE) or dialdehyde-based resins, e.g. glyoxalated polyacrylamide resin, or mixtures thereof. The definition "substantially aldehyde free" means in this context that the wet strength agents or mixtures thereof in average contain aldehyde in an amount of less than about 10, for example less than about 5, or less than about 1, or less than about 0.5% by weight based on the total weight of the wet strength agent.

Epihalohydrin-based resins generally comprise a nitrogen-containing precursor and a halogen containing crosslinker. The crosslinkers can be epihalohydrins including epibromohydrin and/or epichlorohydrin. The nitrogen-containing polymer may be e.g. polyaminoamide and/or polyamine. The polyaminoamide used may be the reaction product of a polycarboxylic acid, for example a dicarboxylic acid and a polyamine. The term "carboxylic acid" is meant to include carboxylic derivatives such as anhydrides and esters. Polycarboxylic acids that can be used include saturated or unsaturated aliphatic or aromatic dicarboxylic acids, such as for example oxalic acid, malonic acid, succinic acid, glutaric acid, adipic acid, azelaic acid, sebacic acid, and mixtures or derivatives thereof. Polyamines that can be used include polyalkylene polyamines, e.g. diethylenetriamine, triethylenetetramine, tetraethylene-pentamine, dipropylenetriamine, and mixtures thereof. The polycarboxylic acid and the polyamine typically are applied in a mole ratio ranging from about 1:0.7 to about 1:1.5.

According to one embodiment, a water-soluble, nitrogen-containing, epihalohydrin-based resin is generally prepared from a polyaminoamide solution. The solution can be aqueous, formed of pure water or water in admixture with a water-miscible solvent, such as ethanol or dimethyl formamide. Many different ways of performing the reaction of epihalohydrin with polyaminoamide have been described, among others in the disclosures of U.S. Pat. No. 3,311,594, U.S. Pat. No. 4,336,835, U.S. Pat. No. 3,891,589 and U.S. Pat. No. 2,926,154. The polyaminoamide-epichlorohydrin resin may be produced according to the methods disclosed for example in U.S. Pat. No. 3,700,623, U.S. Pat. No. 3,772,076, U.S. Pat. No. 5,200,036, U.S. Pat. No. 4,416,729 or according to the method described in EP0776923 in which the organic chlorine content has been reduced and the total halogen content is less than 1% by weight. The dry content of the epihalohydrin-based resin, e.g. polyaminoamide-epichlorohydrin, can be up to about 30, for example from about 5 to about 20, or from about 7.5 to about 15% by weight based on the total weight of the resin.

Dialdehyde-based resins are prepared by reacting a dialdehyde such as for example glyoxal or $C_1$ to $C_8$ saturated or unsaturated alkylene or phenylene dialdehydes with a dialdehyde-reactive comonomer such as for example, acrylamide, methacrylamide, N-methyl acrylamide and N-methyl methacrylamide. For example, glyoxalated poly(acrylate) resins can be prepared by reacting glyoxal with a copolymer of acrylamide and a small amount of cationic comonomer. Such resins are described in U.S. Pat. Nos. 3,556,933 and 4,605,702. A cationic comonomer may be further reacted with the dialdehyde to form the resin. The cationic monomers include tertiary and quaternary diallyl amino derivatives, or tertiary and quaternary amino derivatives of acrylic acid or (meth) acrylic acid or acrylamide or meth(acrylamide), vinylpyridines and quaternary vinylpyridines, or para-styrene derivatives containing tertiary or quaternary aminoderivatives. The cationic monomer may be for example diallyldimethylammonium chloride (DADMAC). The dialdehyde-based resin is for example glyoxalated polyacrylamide resin, herein also referred to as glyoxal-polyacrylamide, which may be produced according to the method disclosed in WO2006/068964. The resins can have a dry content ranging from about 2 to about 25, or for example from about 5 to about 15% by weight. According to one embodiment, the aldehyde content in the resin is less than about 10, for example less than about 7.5, or less than about 5% by weight.

According to one embodiment, the dry content of the web is at least about 20, for example at least about 50, or at least about 90% by weight.

According to one embodiment of the invention the silica-based particles and wet strength agent, herein also referred to as components, are added separately or as a mixture, e.g. in the form of a premix or a dispersion to the formed web. The components can be added in any order or simultaneously. For example, the wet strength agent can be added to the suspension and the silica-based particles to the formed web. The silica-based particles and the wet strength agent can be applied to the formed web by any suitable means in order to impregnate the web, e.g. by means of a size press and/or a spraying device.

Suitable dosages of the silica-based particles calculated as dry content can vary within wide limits. For example, the silica-based particles can be added to the formed web in an amount ranging from about 0.01 to about 50, such as from about 0.05 to about 35, or from about 0.5 to about 30 kg/t (kg/tonne) based on the dry weight of the suspension.

Suitable dosages of the wet strength agent can also vary within wide limits. The wet strength agent can be added to the suspension and/or to the formed web, for example in an amount ranging from about 0.01 to about 50, such as from about 0.05 to about 35, or from about 0.5 to about 30 kg/t based on the dry weight of the suspension.

According to one embodiment, further components are added to the suspension. Examples of such components include drainage and retention aids, conventional fillers, optical brightening agents, sizing agents, dry strength agents, further wet strength agents etc. Examples of suitable drainage and retention aids include cationic and anionic organic polymers, siliceous materials, and mixtures thereof. Examples of suitable conventional fillers include kaolin, china clay, titanium dioxide, gypsum, talc, natural and synthetic calcium carbonates, e.g. chalk, ground marble and precipitated calcium carbonate, hydrogenated aluminum oxides (aluminum trihydroxides), calcium sulfate, barium sulfate, calcium oxalate, etc. Examples of suitable sizing agents include non-cellulose-reactive sizing agents, e.g. rosin-based sizing agents like rosin-based soaps, rosin-based emulsions/dispersions, and cellulose-reactive sizing agents, e.g. emulsions/dispersions of acid anhydrides like alkenyl succinic anhydrides (ASA), alkenyl and alkyl ketene dimers (AKD) and multimers.

The fiber-containing suspension can be derived from several kinds of pulps, such as chemical pulps, e.g. sulfate and sulfite pulps, organosolv pulp, mechanical pulps, such as thermo-mechanical pulp, chemo-thermomechanical pulp, refiner pulp or groundwood pulp from softwood and/or hardwood, or fibers derived from non-wood including one year plants like elephant grass, bagasse, flax, straw, etc. and suspensions based on recycled fibers. According to one embodiment, the fiber-containing suspension contains for example from about 80 to about 100, or from about 95 to about 100% by weight cellulosic fibers based on the total weight of the fibers.

According to one embodiment, the cellulosic product is paper, e.g. fine paper or tissue paper, or board, e.g. paperboard, cardboard, or liquid packaging board.

One further aspect of the invention concerns a dispersion, e.g. an aqueous dispersion comprising silica-based particles and a wet strength agent as defined herein. In one embodiment of the invention, the dispersion comprises silica-based particles and a substantially aldehyde-free wet strength agent, such as an epihalohydrin-based resin, for example polyaminoamide-epichlorohydrin. According to one embodiment of the invention, the dispersion comprises silica-based particles having a specific surface area ranging from about 1000 to about 1700 $m^2/g$ and a wet strength agent.

The dispersion can be obtained by mixing silica-based particles and a wet strength agent. According to one embodiment, the silica-based particles and a wet strength agent are mixed without dilution. According to another embodiment, the silica-based particles and the wet strength agent are diluted in an aqueous phase. For example, the silica-based particles having a specific surface area from about 300 to about 1000 $m^2/g$ can be diluted to a dry content ranging from about 0.1 to about 10, for example from about 0.5 to about 5, or from about 1 to about 2.5% by weight before mixing with the wet strength agent. The silica-based particles having a specific surface area from about 1000 to about 1700 $m^2/g$ can be diluted to a dry content up to about 7, for example ranging from about 0.5 to about 5.5, or from about 1 to about 2.5% by weight before mixing with the wet strength agent. The wet strength agent can be diluted to a dry content ranging from about 0.1 to about 10, for example from about 0.5 to about 5, or from about 1 to about 2.5% by weight before mixing with the silica-based particles. According to one embodiment, the diluted solution of silica-based particles can be added to the diluted wet strength agent solution under stirring.

According to one embodiment, the dry content of silica-based particles and wet strength agent in the dispersion is from about 0.1 to about 10% by weight. For example, a dispersion containing silica-based particles having a specific surface area ranging from about 1000 to about 1700 $m^2/g$, and a wet strength agent, for example an aldehyde-free wet strength agent, can have a dry content ranging from about 0.1 to about 7, for example from about 0.5 to about 5, or from about 1 to about 3.5% by weight. A dispersion containing silica-based particles having a specific surface area ranging from about 300 to about 1000 $m^2/g$, and a wet strength agent, for example an aldehyde-free wet strength agent, can have a dry content ranging from about 0.1 to about 10, for example from about 0.5 to about 5, or from about 1 to about 3.5% by weight.

According to one embodiment, the weight ratio of the silica-based particles to wet strength agent in the dispersion ranges from about 5:1 to about 1:100, e.g. from about 1.5:1 to about 1:20, or from about 1:1 to about 1:10. The dispersion can have a pH within a range from about 2 to about 7, for example from about 2.5 to about 5. Further parameters and properties of the silica-based particles and the wet strength agents may be as defined herein.

According to one embodiment of the invention, the dispersion is used in a papermaking process as an additive, e.g. to a formed cellulosic fiber web and/or to a fiber-containing suspension.

The invention is further illustrated in the following examples which, however, are not intended to limit the same. All parts and percentages refer to part and percent by weight if not otherwise stated.

EXAMPLES

The following additives were used to illustrate the present invention and comparative examples:

Silica-based particles:

| | |
|---|---|
| IWS 1 | Oligomeric silicic acid, batch 1; specific surface area about 1200 $m^2/g$; pH about 2.5 |
| IWS 2 | Colloidal silica; specific surface area about 850 $m^2/g$, pH about 9 |
| IWS 3 | Oligomeric silicic acid, batch 2; specific surface area about 1200 $m^2/g$; pH about 2.5 |
| IWS 4 | Polysilicic acid, IWS 3 stored 5 h; specific surface area about 1100 $m^2/g$, pH about 2.5 |

Wet strength agents:

| | |
|---|---|
| OWS 1 | Polyaminoamide-epichlorohydrin, batch 1; dry content about 15% by weight, pH about 3.5 |
| OWS 2 | Polyaminoamide-epichlorohydrin, batch 2; dry content about 15% by weight, pH about 3.5 |

The following dispersions of silica-based particles and wet strength agent were used:

| | |
|---|---|
| WSAC 1 | Ratio 1:1 dispersion of IWS 1:OWS 1; pH about 3.5 |
| WSAC 2 | Ratio 2:1 dispersion of IWS 1:OWS 1; pH about 3.0 |
| WSAC 3 | Ratio 1:2 dispersion of IWS 1:OWS 1; pH about 3.5 |
| WSAC 4 | Ratio 1:4 dispersion of IWS 3:OWS 2; pH about 3.5 |
| WSAC 5 | Ratio 1:4 dispersion of IWS 3:OWS 2, stored 5 h; pH about 3.5 |

Example 1

Blotting paper samples of bleached softwood kraft pulp with an area of 22 cm×16 cm were treated by impregnation with different additives according to the following method:

- Conditioning the samples at least 24 h at 50% RH, 23° C.
- Weighing the dry samples
- Impregnation in 250 ml of different additive solutions for 2 min
- Pressing between blotting papers (two on each side)
- Weighing the wet samples
- Drying the samples at 92° C. for 9 min in a Japanese cylinder dryer
- Conditioning the samples at least 24 h at 50% RH, 23° C.
- Weighing the dry impregnated samples
- Measuring dry strength and stiffness properties, according to SCAN-P method 67:93 and wet strength and stiffness properties according to SCAN-P method 20:95, by means of a Tensile Strength Tester, supplied by Lorentzon & Wettre, Sweden Dry strength, wet strength and relative wet strength of the samples are presented in Table 1. Dry stiffness, wet stiffness and relative wet stiffness of the samples are presented in Table 2. The dosages were calculated as dry additive on dry paper according to the formula: (dry impregnated weight−dry weight)/dry weight. Test No. 1 shows results without additions. Test Nos. 2 to 6 show results for references in which the samples were impregnated with silica-based particles in the form of oligomeric silicic acid. Test Nos. 7 to 13 show results of the present invention in which the samples were impregnated with a dispersion comprising silica-based particles and polyaminoamide-epichlorohydrin.

TABLE 1

| Test No. | Additive | Dosage (kg/t) | Dry strength index (kNm/kg) | Wet strength index (kNm/kg) | Relative wet strength (%) |
|---|---|---|---|---|---|
| 1 | Water | — | 13.13 | 0.825 | 6.3 |
| 2 | 0.2% IWS 1 | 1.4 | 13.26 | 0.892 | 6.7 |
| 3 | 0.4% IWS 1 | 2.3 | 13.95 | 0.987 | 7.1 |
| 4 | 0.8% IWS 1 | 3.7 | 13.58 | 1.071 | 7.9 |
| 5 | 1.6% IWS 1 | 7.2 | 14.67 | 1.544 | 10.5 |
| 6 | 3.2% IWS 1 | 16.5 | 15.99 | 2.204 | 13.8 |
| 7 | 0.2% WSAC 1 | 2.6 | 14.79 | 1.772 | 12.0 |
| 8 | 0.4% WSAC 1 | 3.1 | 14.56 | 1.697 | 11.7 |
| 9 | 0.8% WSAC 1 | 4.7 | 15.30 | 2.190 | 14.3 |
| 10 | 1.6% WSAC 1 | 9.8 | 17.16 | 2.507 | 14.6 |
| 11 | 3.2% WSAC 1 | 21.9 | 18.53 | 3.126 | 16.9 |
| 12 | 3.2% WSAC 2 | 22.6 | 18.82 | 2.097 | 11.1 |
| 13 | 3.2% WSAC 3 | 26.6 | 19.44 | 2.917 | 15.0 |

TABLE 2

| Test No. | Additive | Dosage (kg/t) | Dry stiffness index (MNm/kg) | Wet stiffness index (MNm/kg) | Relative wet stiffness (%) |
|---|---|---|---|---|---|
| 1 | Water | — | 2.00 | 0.0670 | 3.4 |
| 2 | 0.2% IWS 1 | 1.4 | 2.00 | 0.0769 | 3.8 |
| 3 | 0.4% IWS 1 | 2.3 | 2.12 | 0.0896 | 4.2 |
| 4 | 0.8% IWS 1 | 3.7 | 2.05 | 0.1011 | 4.9 |
| 5 | 1.6% IWS 1 | 7.2 | 2.14 | 0.1648 | 7.7 |
| 6 | 3.2% IWS 1 | 16.5 | 2.28 | 0.2462 | 10.8 |
| 7 | 0.2% WSAC 1 | 2.6 | 2.07 | 0.2154 | 10.4 |
| 8 | 0.4% WSAC 1 | 3.1 | 2.13 | 0.2014 | 9.5 |
| 9 | 0.8% WSAC 1 | 4.7 | 2.18 | 0.2137 | 9.8 |
| 10 | 1.6% WSAC 1 | 9.8 | 2.39 | 0.2687 | 11.2 |
| 11 | 3.2% WSAC 1 | 21.9 | 2.36 | 0.2989 | 12.7 |
| 12 | 3.2% WSAC 2 | 22.6 | 2.61 | 0.2808 | 10.8 |
| 13 | 3.2% WSAC 3 | 26.6 | 2.56 | 0.3253 | 12.7 |

As can be seen from the results presented in Tables 1 and 2, the paper samples impregnated according to the present invention show improvements in wet strength, wet stiffness, relative wet strength and/or relative wet stiffness.

Example 2

Paper sheets, produced from disintegrated bleached softwood kraft pulp (100% pine), were prepared in a Dynamic Sheet Former (Formette Dynamique) supplied by Fibertech AB, Sweden.

The impregnations were made according to the method described in Example 1 with dosages according to Tables 3 and 4. The wet strength agent was added to the fiber-containing suspension. Dry strength, wet strength and relative wet strength of the samples are presented in Table 3. Dry stiffness, wet stiffness and relative wet stiffness of the samples are presented in Table 4. The dosages were calculated as dry additive on dry paper.

TABLE 3

| Test No. | Additive | Total dosage (kg/t) | Dry strength index (kNm/kg) | Wet strength index (kNm/kg) | Relative wet strength (%) |
|---|---|---|---|---|---|
| 1 | Water | — | 35.70 | 1.76 | 4.9 |
| 2 | 3.2% IWS 1 | 11.1 | 36.74 | 2.25 | 6.1 |
| 3 | 3.2% IWS 2 | 13.8 | 55.23 | 7.67 | 13.9 |
| 4 | 10 kg/t OWS 1 | 10.0 | 48.53 | 10.75 | 22.2 |
| 5 | 10 kg/t OWS 1 + 0.4% IWS 1 | 12.1 | 55.33 | 12.34 | 22.3 |
| 6 | 10 kg/t OWS 1 + 0.8% IWS 1 | 16.2 | 54.10 | 12.61 | 23.3 |
| 7 | 10 kg/t OWS 1 + 1.6% IWS 1 | 22.2 | 60.06 | 13.82 | 23.0 |
| 8 | 10 kg/t OWS 1 + 3.2% IWS 1 | 35.8 | 60.83 | 16.20 | 26.6 |
| 9 | 10 kg/t OWS 1 + 0.8% IWS 2 | 10.8 | 54.19 | 12.47 | 23.0 |
| 10 | 10 kg/t OWS 1 + 3.2% IWS 2 | 22.9 | 60.65 | 15.92 | 26.2 |

TABLE 4

| Test No. | Additive | Total dosage (kg/t) | Dry stiffness index (MNm/kg) | Wet stiffness index (MNm/kg) | Relative wet stiffness (%) |
|---|---|---|---|---|---|
| 1 | Water | — | 5.78 | 0.205 | 3.5 |
| 2 | 3.2% IWS 1 | 11.1 | 6.44 | 0.536 | 8.3 |

TABLE 4-continued

| Test No. | Additive | Total dosage (kg/t) | Dry stiffness index (MNm/kg) | Wet stiffness index (MNm/kg) | Relative wet stiffness (%) |
|---|---|---|---|---|---|
| 3 | 3.2% IWS 2 | 13.8 | 7.34 | 0.756 | 10.3 |
| 4 | 10 kg/t OWS 1 | 10 | 6.29 | 0.606 | 9.6 |
| 5 | 10 kg/t OWS 1 + 0.4% IWS 1 | 12.1 | 6.34 | 0.634 | 10.0 |
| 6 | 10 kg/t OWS 1 + 0.8% IWS 1 | 16.2 | 6.00 | 0.671 | 11.2 |
| 7 | 10 kg/t OWS 1 + 1.6% IWS 1 | 22.2 | 6.64 | 0.743 | 11.2 |
| 8 | 10 kg/t OWS 1 + 3.2% IWS 1 | 35.8 | 6.76 | 0.868 | 12.8 |
| 9 | 10 kg/t OWS 1 + 0.8% IWS 2 | 10.8 | 6.84 | 0.676 | 9.9 |
| 10 | 10 kg/t OWS 1 + 3.2% IWS 2 | 22.9 | 6.66 | 0.740 | 11.1 |

As can be seen from the results presented in Tables 3 and 4, the samples impregnated according to the present invention show improvements in wet strength, wet stiffness, relative wet strength and/or relative wet stiffness.

Example 3

Blotting papers of bleached softwood kraft pulp were impregnated with silica-based particles and/or wet strength agent according to the method described in Example 1 and with dosages according to Tables 5 and 6. Dry strength, wet strength and relative wet strength of the samples are presented in Table 5. Dry stiffness, wet stiffness and relative wet stiffness of the samples are presented in Table 6. The dosages were calculated as dry additive on dry paper.

TABLE 5

| Test No. | Additive | Dosage (kg/t) | Dry strength index (kNm/kg) | Wet strength index (kNm/kg) | Relative wet strength (%) |
|---|---|---|---|---|---|
| 1 | Water | — | 24.69 | 1.260 | 5.1 |
| 2 | 0.4% IWS 3 | 6.2 | 26.18 | 1.431 | 5.5 |
| 3 | 0.8% IWS 3 | 8.8 | 28.58 | 1.786 | 6.2 |
| 4 | 1.2% IWS 3 | 10.2 | 28.89 | 2.051 | 7.1 |
| 5 | 1.6% IWS 3 | 11.8 | 26.50 | 2.319 | 8.8 |
| 6 | 2.4% IWS 3 | 16.6 | 29.11 | 2.843 | 9.8 |
| 7 | 2.4% IWS 4 | 14.5 | 28.45 | 3.295 | 11.6 |
| 8 | 0.4% OWS 2 | 6.1 | 26.66 | 3.862 | 14.5 |
| 9 | 0.8% OWS 2 | 8.7 | 26.74 | 3.636 | 13.6 |
| 10 | 1.2% OWS 2 | 9.0 | 28.18 | 4.260 | 15.1 |
| 11 | 1.6% OWS 2 | 11.5 | 28.42 | 5.301 | 18.7 |
| 12 | 2.4% OWS 2 | 15.2 | 31.28 | 5.852 | 18.7 |
| 13 | 0.4% WSAC 4 | 10.3 | 30.92 | 4.483 | 14.5 |
| 14 | 0.8% WSAC 4 | 9.7 | 28.73 | 3.894 | 13.6 |
| 15 | 1.2% WSAC 4 | 12.2 | 30.27 | 4.064 | 13.4 |
| 16 | 1.6% WSAC 4 | 12.2 | 29.02 | 4.542 | 15.7 |
| 17 | 2.4% WSAC 4 | 17.3 | 33.06 | 5.879 | 17.8 |
| 18 | 2.4% WSAC 5 | 14.3 | 28.05 | 5.765 | 20.6 |

TABLE 6

| Test No. | Additive | Dosage (kg/t) | Dry stiffness index (MNm/kg) | Wet stiffness index (MNm/kg) | Relative wet stiffness (%) |
|---|---|---|---|---|---|
| 1 | Water | — | 3.90 | 0.1754 | 4.5 |
| 2 | 0.4% IWS 3 | 6.2 | 4.04 | 0.2241 | 5.5 |
| 3 | 0.8% IWS 3 | 8.8 | 4.33 | 0.2882 | 6.7 |
| 4 | 1.2% IWS 3 | 10.2 | 4.33 | 0.3231 | 7.5 |

TABLE 6-continued

| Test No. | Additive | Dosage (kg/t) | Dry stiffness index (MNm/kg) | Wet stiffness index (MNm/kg) | Relative wet stiffness (%) |
|---|---|---|---|---|---|
| 5 | 1.6% IWS 3 | 11.8 | 3.93 | 0.3638 | 9.3 |
| 6 | 2.4% IWS 3 | 16.6 | 4.23 | 0.4818 | 11.4 |
| 7 | 2.4% IWS 4 | 14.5 | 4.06 | 0.5014 | 12.3 |
| 8 | 0.4% OWS 2 | 6.1 | 3.93 | 0.5159 | 13.1 |
| 9 | 0.8% OWS 2 | 8.7 | 3.93 | 0.4649 | 11.8 |
| 10 | 1.2% OWS 2 | 9.0 | 4.01 | 0.5009 | 12.5 |
| 11 | 1.6% OWS 2 | 11.5 | 4.01 | 0.5264 | 13.1 |
| 12 | 2.4% OWS 2 | 15.2 | 4.41 | 0.5305 | 12.0 |
| 13 | 0.4% WSAC 4 | 10.3 | 4.46 | 0.5726 | 12.8 |
| 14 | 0.8% WSAC 4 | 9.7 | 4.15 | 0.5112 | 12.3 |
| 15 | 1.2% WSAC 4 | 12.2 | 4.28 | 0.5100 | 11.9 |
| 16 | 1.6% WSAC 4 | 12.2 | 4.09 | 0.5094 | 12.4 |
| 17 | 2.4% WSAC 4 | 17.3 | 4.51 | 0.5771 | 12.8 |
| 18 | 2.4% WSAC 5 | 14.3 | 3.85 | 0.5425 | 14.1 |

As can be seen from the results presented in Tables 5 and 6, the samples impregnated according to the present invention show improvements in wet strength, wet stiffness, relative wet strength and/or relative wet stiffness.

The invention claimed is:

1. A process for the production of a cellulosic product comprising:

(I) providing a fiber-containing suspension, wherein at least about 60% by weight of the fibers are cellulosic fibers;

(II) dewatering the suspension on a wire to form a cellulosic fiber web;

wherein the process further comprises adding:

(i) silica-based particles having a specific surface area of from about 100 to about 1700 $m^2/g$ to the formed web; and (ii) a wet strength agent to the formed web.

2. The process according to claim 1, wherein the silica-based particles and the wet strength agent are added as a mixture.

3. The process according to claim 1, wherein the silica-based particles and the wet strength agent are added separately.

4. The process according to claim 1, wherein the silica-based particles have a specific surface area ranging from about 1000 to about 1700 $m^2/g$.

5. The process according to claim 1, wherein the silica-based particles are added to the formed web in an amount ranging from about 0.05 to about 35 kg/t based on the dry weight of the suspension.

6. The process according to claim 1, wherein the wet strength agent is polyaminoamide-epichlorohydrin.

7. The process according to claim 1, wherein the wet strength agent has an aldehyde content of less than about 10% by weight based on the total weight of the wet strength agent.

8. The process according to claim 1, wherein the wet strength agent is polyaminoamide-epichlorohydrin.

9. The process according to claim 1, wherein the formed web has a dry content of at least about 20% by weight.

10. The process according to claim 1, wherein the silica-based particles are applied to the formed web by means of a size press or spraying device.

11. The process according to claim 1, wherein the cellulosic product is a board.

12. The process according to claim 1, wherein the wet strength agent is added to the formed web in an amount ranging from about 0.05 to about 35 kg/t based on the dry weight of the suspension.

13. The process according to claim 12, wherein the wet strength agent is polyaminoamide-epichlorohydrin.

14. The process according to claim 1, wherein the wet strength agent is applied to the formed web by means of a size press or spraying device.

15. The process according to claim 1, wherein the silica-based particles and wet strength agent are applied to the formed web by means of a size press or spraying device.

* * * * *